US008074750B2

(12) United States Patent
Choe et al.

(10) Patent No.: US 8,074,750 B2
(45) Date of Patent: Dec. 13, 2011

(54) EARTH-BORING TOOLS COMPRISING SILICON CARBIDE COMPOSITE MATERIALS, AND METHODS OF FORMING SAME

(75) Inventors: Heeman Choe, Seoul (KR); John H. Stevens, Spring, TX (US); James L. Overstreet, Tomball, TX (US); Jimmy W. Eason, The Woodlands, TX (US); James C. Westhoff, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/875,570

(22) Filed: Sep. 3, 2010

(65) Prior Publication Data

US 2010/0326739 A1 Dec. 30, 2010

Related U.S. Application Data

(60) Division of application No. 11/965,018, filed on Dec. 27, 2007, now Pat. No. 7,807,099, which is a continuation-in-part of application No. 11/271,153, filed on Nov. 10, 2005, now Pat. No. 7,802,495, and a continuation-in-part of application No. 11/272,439, filed on Nov. 10, 2005, now Pat. No. 7,776,256.

(51) Int. Cl.
*E21B 10/00* (2006.01)
*B22D 19/14* (2006.01)

(52) U.S. Cl. ..... 175/425; 175/374; 75/236; 75/249; 164/97; 164/98

(58) Field of Classification Search ..... 75/249, 75/236; 419/14; 175/374, 425; 164/97, 164/98
See application file for complete search history.

(56) References Cited

U.S. PATENT DOCUMENTS

| | | | |
|---|---|---|---|
| 1,676,887 | A | 7/1928 | Chamberlin |
| 1,954,166 | A | 4/1934 | Campbell |
| 2,299,207 | A | 10/1942 | Bevillard |
| 2,507,439 | A | 5/1950 | Goolsbee |
| 2,819,958 | A | 1/1958 | Abkowitz et al. |
| 2,819,959 | A | 1/1958 | Abkowitz |
| 2,906,654 | A | 9/1959 | Abkowitz |
| 3,368,881 | A | 2/1968 | Abkowitz et al. |
| 3,471,921 | A | 10/1969 | Feenstra |
| 3,660,050 | A | 5/1972 | Iler et al. |
| 3,757,878 | A | 9/1973 | Wilder et al. |
| 3,757,879 | A | 9/1973 | Wilder et al. |
| 3,841,852 | A | 10/1974 | Wilder et al. |
| 3,880,971 | A | 4/1975 | Pantanelli |
| 3,987,859 | A | 10/1976 | Lichte |
| 4,017,480 | A | 4/1977 | Baum |
| 4,047,828 | A | 9/1977 | Makely |
| 4,094,709 | A | 6/1978 | Rozmus |
| 4,098,363 | A | 7/1978 | Rohde et al. |
| 4,128,136 | A | 12/1978 | Generoux |
| 4,134,759 | A | 1/1979 | Yajima et al. |
| 4,157,122 | A | 6/1979 | Morris |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,252,202 | A | 2/1981 | Purser, Sr. |
| 4,255,165 | A | 3/1981 | Dennis et al. |
| 4,306,139 | A | 12/1981 | Shinozaki et al. |
| 4,341,557 | A | 7/1982 | Lizenby |
| 4,389,952 | A | 6/1983 | Dreier et al. |
| 4,398,952 | A | 8/1983 | Drake |
| 4,453,605 | A | 6/1984 | Short et al. |
| 4,499,048 | A | 2/1985 | Hanejko |
| 4,499,795 | A | 2/1985 | Radtke |
| 4,499,958 | A | 2/1985 | Radtke et al. |
| 4,503,009 | A | 3/1985 | Asaka |
| 4,526,748 | A | 7/1985 | Rozmus |
| 4,552,232 | A | 11/1985 | Frear |
| 4,554,130 | A | 11/1985 | Ecer |
| 4,562,990 | A | 1/1986 | Rose |
| 4,596,694 | A | 6/1986 | Rozmus |
| 4,597,730 | A | 7/1986 | Rozmus |
| 4,620,600 | A | 11/1986 | Persson |

(Continued)

FOREIGN PATENT DOCUMENTS

| | | |
|---|---|---|
| AU | 695583 | 2/1998 |

(Continued)

OTHER PUBLICATIONS

"Boron Carbide Nozzles and Inserts," Seven Stars International webpage http://www.concentric.net/~ctkang/nozzle.shtml, printed Sep. 7, 2006, 8 pages.

"Heat Treating of Titanium and Titanium Alloys," Key to Metals website article, www.key-to-metals.com, printed Sep. 21, 2006, 7 pages.

Al-Haidary, J.T., et al., "Evaluation Study of Cast Al-SiCp Composites," Materials Science-Poland, vol. 25, No. 1, 2007.

Alman et al., "The Abrasive Wear of Sintered Titanium Matrix-Ceramic Particle Reinforced Composites," WEAR, 225-229, pp. 629-639, 1999.

(Continued)

*Primary Examiner* — Roy King
*Assistant Examiner* — Ngoclan Mai
(74) *Attorney, Agent, or Firm* — TraskBritt

(57) ABSTRACT

Earth-boring tools for drilling subterranean formations include a particle-matrix composite material comprising a plurality of silicon carbide particles dispersed throughout a matrix material, such as, for example, an aluminum or aluminum-based alloy. In some embodiments, the silicon carbide particles comprise an ABC-SiC material. Methods of manufacturing such tools include providing a plurality of silicon carbide particles within a matrix material. Optionally, the silicon carbide particles may comprise ABC-SiC material, and the ABC-SiC material may be toughened to increase a fracture toughness exhibited by the ABC-SiC material. In some methods, at least one of an infiltration process and a powder compaction and consolidation process may be employed.

11 Claims, 3 Drawing Sheets

U.S. PATENT DOCUMENTS

| | | | | |
|---|---|---|---|---|
| 4,686,080 | A | | 8/1987 | Hara et al. |
| 4,694,919 | A | | 9/1987 | Barr |
| 4,738,322 | A | | 4/1988 | Hall et al. |
| 4,743,515 | A | | 5/1988 | Fischer et al. |
| 4,744,943 | A | | 5/1988 | Timm |
| 4,774,211 | A | | 9/1988 | Hamilton et al. |
| 4,809,903 | A | | 3/1989 | Eylon et al. |
| 4,838,366 | A | | 6/1989 | Jones |
| 4,871,377 | A | | 10/1989 | Frushour |
| 4,881,431 | A | | 11/1989 | Bieneck |
| 4,884,477 | A | | 12/1989 | Smith et al. |
| 4,889,017 | A | | 12/1989 | Fuller et al. |
| 4,919,013 | A | | 4/1990 | Smith et al. |
| 4,923,512 | A | | 5/1990 | Timm et al. |
| 4,940,099 | A | | 7/1990 | Deane et al. |
| 4,956,012 | A | | 9/1990 | Jacobs et al. |
| 4,968,348 | A | | 11/1990 | Abkowitz et al. |
| 4,981,665 | A | | 1/1991 | Boecker et al. |
| 5,000,273 | A | | 3/1991 | Horton et al. |
| 5,030,598 | A | | 7/1991 | Hsieh |
| 5,032,352 | A | | 7/1991 | Meeks et al. |
| 5,049,450 | A | | 9/1991 | Dorfman et al. |
| 5,090,491 | A | | 2/1992 | Tibbitts et al. |
| 5,101,692 | A | | 4/1992 | Simpson |
| 5,150,636 | A | | 9/1992 | Hill |
| 5,161,898 | A | | 11/1992 | Drake |
| 5,232,522 | A | | 8/1993 | Doktycz et al. |
| 5,281,260 | A | | 1/1994 | Kumar et al. |
| 5,286,685 | A | | 2/1994 | Schoennahl et al. |
| 5,311,958 | A | | 5/1994 | Isbell et al. |
| 5,322,139 | A | | 6/1994 | Rose et al. |
| 5,333,699 | A | | 8/1994 | Thigpen et al. |
| 5,348,806 | A | | 9/1994 | Kojo et al. |
| 5,372,777 | A | * | 12/1994 | Yang ..... 419/47 |
| 5,373,907 | A | | 12/1994 | Weaver |
| 5,433,280 | A | | 7/1995 | Smith |
| 5,439,068 | A | | 8/1995 | Huffstutler et al. |
| 5,443,337 | A | | 8/1995 | Katayama |
| 5,445,231 | A | | 8/1995 | Scott et al. |
| 5,455,000 | A | | 10/1995 | Seyferth et al. |
| 5,467,669 | A | | 11/1995 | stroud |
| 5,479,997 | A | | 1/1996 | Scott et al. |
| 5,482,670 | A | | 1/1996 | Hong |
| 5,484,468 | A | | 1/1996 | Ostlund et al. |
| 5,492,186 | A | | 2/1996 | Overstreet et al. |
| 5,506,055 | A | | 4/1996 | Dorfman et al. |
| 5,541,006 | A | | 7/1996 | Conley |
| 5,543,235 | A | | 8/1996 | Mirchandani et al. |
| 5,544,550 | A | | 8/1996 | Smith |
| 5,560,440 | A | | 10/1996 | Tibbitts |
| 5,586,612 | A | | 12/1996 | Isbell et al. |
| 5,593,474 | A | | 1/1997 | Keshavan et al. |
| 5,611,251 | A | | 3/1997 | Katayama |
| 5,612,264 | A | | 3/1997 | Nilsson et al. |
| 5,624,002 | A | | 4/1997 | Huffstutler |
| 5,641,251 | A | | 6/1997 | Leins et al. |
| 5,641,921 | A | | 6/1997 | Dennis et al. |
| 5,662,183 | A | | 9/1997 | Fang |
| 5,666,864 | A | | 9/1997 | Tibbitts |
| 5,677,042 | A | | 10/1997 | Massa et al. |
| 5,679,445 | A | | 10/1997 | Massa et al. |
| 5,697,046 | A | | 12/1997 | Conley |
| 5,697,462 | A | | 12/1997 | Grimes et al. |
| 5,710,969 | A | | 1/1998 | Newman |
| 5,725,827 | A | | 3/1998 | Rhodes et al. |
| 5,732,783 | A | | 3/1998 | Truax et al. |
| 5,733,649 | A | | 3/1998 | Kelley et al. |
| 5,733,664 | A | | 3/1998 | Kelley et al. |
| 5,740,872 | A | | 4/1998 | Smith |
| 5,753,160 | A | | 5/1998 | Takeuchi et al. |
| 5,765,095 | A | | 6/1998 | Flak et al. |
| 5,776,593 | A | | 7/1998 | Massa et al. |
| 5,778,301 | A | | 7/1998 | Hong |
| 5,789,686 | A | | 8/1998 | Massa et al. |
| 5,792,403 | A | | 8/1998 | Massa et al. |
| 5,806,934 | A | | 9/1998 | Massa et al. |
| 5,829,539 | A | | 11/1998 | Newton et al. |
| 5,830,256 | A | | 11/1998 | Northrop et al. |
| 5,856,626 | A | | 1/1999 | Fischer et al. |
| 5,865,571 | A | | 2/1999 | Tankala et al. |
| 5,878,634 | A | | 3/1999 | Tibbitts |
| 5,880,382 | A | | 3/1999 | Fang et al. |
| 5,897,830 | A | | 4/1999 | Abkowitz et al. |
| 5,904,212 | A | | 5/1999 | Arfele |
| 5,947,214 | A | | 9/1999 | Tibbitts |
| 5,957,006 | A | | 9/1999 | Smith |
| 5,963,775 | A | | 10/1999 | Fang |
| 5,967,248 | A | | 10/1999 | Drake et al. |
| 5,979,575 | A | | 11/1999 | Overstreet et al. |
| 5,980,602 | A | | 11/1999 | Carden |
| 6,029,544 | A | | 2/2000 | Katayama |
| 6,045,750 | A | | 4/2000 | Drake et al. |
| 6,051,171 | A | | 4/2000 | Takeuchi et al. |
| 6,063,333 | A | | 5/2000 | Dennis |
| 6,068,070 | A | | 5/2000 | Scott |
| 6,073,518 | A | | 6/2000 | Chow et al. |
| 6,086,980 | A | | 7/2000 | Foster et al. |
| 6,089,123 | A | | 7/2000 | Chow et al. |
| 6,099,664 | A | | 8/2000 | Davies et al. |
| 6,148,936 | A | | 11/2000 | Evans et al. |
| 6,200,514 | B1 | | 3/2001 | Meister |
| 6,209,420 | B1 | | 4/2001 | Butcher et al. |
| 6,214,134 | B1 | | 4/2001 | Eylon et al. |
| 6,214,287 | B1 | | 4/2001 | Waldenstrom |
| 6,220,117 | B1 | | 4/2001 | Butcher |
| 6,227,188 | B1 | | 5/2001 | Tankala et al. |
| 6,228,139 | B1 | | 5/2001 | Oskarrson |
| 6,241,036 | B1 | | 6/2001 | Lovato et al. |
| 6,254,658 | B1 | | 7/2001 | Taniuchi et al. |
| 6,284,014 | B1 | | 9/2001 | Carden |
| 6,287,360 | B1 | | 9/2001 | Kembaiyan et al. |
| 6,290,438 | B1 | | 9/2001 | Papajewski |
| 6,293,986 | B1 | | 9/2001 | Rodiger et al. |
| 6,322,746 | B1 | | 11/2001 | LaSalle et al. |
| 6,348,110 | B1 | | 2/2002 | Evans |
| 6,375,706 | B2 | | 4/2002 | Kembaiyan et al. |
| 6,408,958 | B1 | | 6/2002 | Isbell et al. |
| 6,453,899 | B1 | | 9/2002 | Tselesin |
| 6,454,025 | B1 | | 9/2002 | Runquist et al. |
| 6,454,028 | B1 | | 9/2002 | Evans |
| 6,454,030 | B1 | | 9/2002 | Findley et al. |
| 6,458,471 | B2 | | 10/2002 | Lovato et al. |
| 6,474,425 | B1 | | 11/2002 | Truax et al. |
| 6,500,226 | B1 | | 12/2002 | Dennis |
| 6,503,572 | B1 | | 1/2003 | Waggoner et al. |
| 6,511,265 | B1 | | 1/2003 | Mirchandani et al. |
| 6,576,182 | B1 | | 6/2003 | Ravagni et al. |
| 6,589,640 | B2 | | 7/2003 | Griffin et al. |
| 6,607,693 | B1 | | 8/2003 | Saito et al. |
| 6,615,935 | B2 | | 9/2003 | Fang et al. |
| 6,655,481 | B2 | | 12/2003 | Findley et al. |
| 6,685,880 | B2 | | 2/2004 | Engstrom et al. |
| 6,742,608 | B2 | | 6/2004 | Murdoch |
| 6,742,611 | B1 | | 6/2004 | Illerhaus et al. |
| 6,756,009 | B2 | | 6/2004 | Sim et al. |
| 6,766,870 | B2 | | 7/2004 | Overstreet |
| 6,782,958 | B2 | | 8/2004 | Liang et al. |
| 6,849,231 | B2 | | 2/2005 | Kojima et al. |
| 6,862,970 | B2 | | 3/2005 | Aghajanian et al. |
| 6,908,688 | B1 | | 6/2005 | Majagi et al. |
| 6,918,942 | B2 | | 7/2005 | Hatta et al. |
| 6,995,103 | B2 | | 2/2006 | Aghajanian |
| 7,044,243 | B2 | | 5/2006 | Kembaiyan et al. |
| 7,048,081 | B2 | | 5/2006 | Smith et al. |
| 7,395,882 | B2 | | 7/2008 | Oldham et al. |
| 7,513,320 | B2 | | 4/2009 | Mirchandani et al. |
| 2002/0004105 | A1 | | 1/2002 | Kunze et al. |
| 2003/0010409 | A1 | | 1/2003 | Kunze et al. |
| 2004/0007393 | A1 | | 1/2004 | Griffin |
| 2004/0013558 | A1 | | 1/2004 | Kondoh et al. |
| 2004/0060742 | A1 | | 4/2004 | Kembaiyan et al. |
| 2004/0196638 | A1 | | 10/2004 | Lee et al. |
| 2004/0243241 | A1 | | 12/2004 | Istephanous et al. |
| 2004/0245022 | A1 | | 12/2004 | Izaguirre et al. |
| 2004/0245024 | A1 | | 12/2004 | Kembaiyan |
| 2005/0008524 | A1 | | 1/2005 | Testani |
| 2005/0072496 | A1 | | 4/2005 | Hwang et al. |

| | | | |
|---|---|---|---|
| 2005/0084407 | A1 | 4/2005 | Myrick |
| 2005/0117984 | A1 | 6/2005 | Eason et al. |
| 2005/0126334 | A1 | 6/2005 | Mirchandani |
| 2005/0211474 | A1 | 9/2005 | Nguyen et al. |
| 2005/0211475 | A1 | 9/2005 | Mirchandani et al. |
| 2005/0247491 | A1 | 11/2005 | Mirchandani et al. |
| 2005/0268746 | A1 | 12/2005 | Abkowitz et al. |
| 2006/0016521 | A1 | 1/2006 | Hanusiak et al. |
| 2006/0032677 | A1 | 2/2006 | Azar et al. |
| 2006/0043648 | A1 | 3/2006 | Takeuchi et al. |
| 2006/0057017 | A1 | 3/2006 | Woodfield et al. |
| 2006/0131081 | A1 | 6/2006 | Mirchandani et al. |
| 2006/0231293 | A1 | 10/2006 | Ladi et al. |
| 2007/0042217 | A1 | 2/2007 | Fang et al. |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |
| 2008/0202814 | A1 | 8/2008 | Lyons et al. |
| 2009/0031863 | A1 | 2/2009 | Lyons et al. |
| 2009/0044663 | A1 | 2/2009 | Stevens et al. |

FOREIGN PATENT DOCUMENTS

| | | | |
|---|---|---|---|
| CA | 2212197 | | 10/2000 |
| EP | 0264674 | A2 | 4/1988 |
| EP | 0453428 | A1 | 10/1991 |
| EP | 0995876 | A2 | 4/2000 |
| EP | 1244531 | B1 | 10/2002 |
| GB | 945227 | | 12/1963 |
| GB | 2017153 | | 10/1979 |
| GB | 2203774 | A | 10/1988 |
| GB | 2345930 | A | 7/2000 |
| GB | 2385350 | A | 8/2003 |
| GB | 2393449 | A | 3/2004 |
| JP | 10219385 | A | 8/1998 |
| WO | 03049889 | A2 | 6/2003 |
| WO | 2004053197 | A2 | 6/2004 |

OTHER PUBLICATIONS

Basavarajappa, S., et al., "Dry Sliding Wear Behaviour of Al 2219/SiC Metal Matrix Composites," Materials Science-Poland, vol. 24, No. 2/1, 2006.

Chen, D., et al., "High-Temperature Cyclic Fatigue-Crack Growth Behavior in an In Situ Toughened Silicon Carbide," Acta mater., vol. 48, pp. 659-674, 2000.

Chen, D., et al., "Mechanisms of High-Temperature Fatigue in Silicon Carbide Ceramics," Fatigue and Fracture Behavior of High Temperature Materials, TMS (The Minerals, Metals & Materials Society), Warrendale, PA, pp. 1-8, 2000.

Chen, D., et al., "Role of the Grain-Boundary Phase on the Elevated-Temperature Strength, Toughness, Fatigue and Creep Resistance of Silicon Carbide Sintered with Al, B and C," Acta mater., vol. 48, pp. 4599-4608, 2000.

Choe et al., "Effect of Tungsten Additions on the Mechanical Properties of Ti-6A1-4V," Material Science and Engineering, A 396, pp. 99-106, 2005.

Diamond Innovations, "Composite Diamond Coatings, Superhard Protection of Wear Parts New Coating and Service Parts from Diamond Innovations" Brochure, 7 pages, 2004.

Gale et al., Smithells Metals Reference Book, Eighth Edition, p. 2117, 2003.

International Search Report and Written Opinion of the International Search Authority for International Application No. PCT/US2006/043669, mailed Apr. 13, 2007.

International Search Report and Written Opinion of the International Search Authority for International Application No. PCT/US2006/043670, mailed Apr. 2, 2007.

International Search Report for International Application No. PCT/US2009/046812 dated Jan. 26, 2010, 5 pages.

International Search Report for International PCT International Application No. PCT/US2007/023275, mailed Apr. 11, 2008.

International Written Opinion for International Application No. PCT/US2009/046812 dated Jan. 26, 2010, 5 pages.

Key-To-Nonferrous, "Aluminum Matrix Composites with Discontinuous Silicon Carbide Reinforcement," http://www.key-to-nonferrous.com, 3 pages, downloaded Aug. 27, 2007.

M Cubed Technologies Inc., "Cast Silicon Carbide Particulate-Reinforced Aluminum (Al/SiC) Metal Matrix Composites," Technote, Cast MMC, Rev. 02, 3 pages, May 8, 2001.

Mabuchi, M., et al., "Very High Strain-Rate Superplasticity in a Particulate Si3N4/6061 Aluminum Composite," Scripta Metallurgica et Materialia, vol. 25, No. 11, pp. 2517-2520, Copyright (c) Pergamon Press plc., 1991.

Miserez et al. "Particle Reinforced Metals of High Ceramic Content," Material Science and Engineering A 387-389, pp. 822-831, Elsevier., 2004.

Moberlychan, W.J., et al., "Controlling Interface Chemistry and Structure to Process and Toughen Silicon Carbide," Acta mater., vol. 46, No. 7, pp. 2471-2477, 1998.

Moberlychan, W.J., et al., "The Roles of Amorphous Grain Boundaries and the β-α Transformation in Toughening SiC," Acta mater., vol. 46, No. 5, pp. 1625-1635, 1998.

PCT International Search Report for International Application No. PCT/US2008/087647, mailed Jul. 23, 2009, 5 pages.

PCT International Written Opinion for International Application No. PCT/US2008/087647, mailed Jul. 23, 2009, 5 pages.

Pruthviraj, R.D., et al., "Friction and Wear of Al6061 Containing 10wt.% Sic Metal Matrix Composites," International Journal of Material Science, vol. 2, No. 1, pp. 59-64, 2007.

Reed, "Chapter 13: Particle Packing Characteristics," Principles of Ceramics Processing, Second Edition, John Wiley & Sons, Inc., pp. 215-227, 1995.

U.S. Appl. No. 60/566,063, filed Apr. 28, 2004, entitled "Body Materials for Earth Boring Bits" to Mirchandani et al.

Warrier et al., "Infiltration of Titanium Alloy-Matrix Composites," Journal of Materials Science Letters, 12, pp. 865-868, Chapman & Hall, 1993.

Yang, Guang, et al., "Chemical Reaction in Al Matrix Composite Reinforced with Sicp Coated by SnO2," Journal of Materials Science, vol. 39, pp. 3689-3694, 2004.

Yuan, R., et al., "Ambient to High-Temperature Fracture Toughness and Cyclic Fatigue Behavior in Al-Containing Silicon Carbide Ceramics," Acta mater., vol. 51, pp. 6477-6491, 2003.

Zhang, Xiao Feng, et al., "Abrasive Wear Behavior of Heat-Treated ABC-Silicon Carbide," J. Am. Ceram. Soc., vol. 86, No. 8, pp. 1370-1378, 2003.

US 4,966,627, 10/1990, Keshavan et al. (withdrawn)

* cited by examiner

EARTH-BORING TOOLS COMPRISING SILICON CARBIDE COMPOSITE MATERIALS, AND METHODS OF FORMING SAME

CROSS-REFERENCE TO RELATED APPLICATIONS

This application is a divisional of U.S. patent application Ser. No. 11/965,018, filed Dec. 27, 2007, now U.S. Pat. No. 7,807,099, issued Oct. 5, 2010, which is a continuation-in-part of U.S. patent application Ser. No. 11/271,153, filed Nov. 10, 2005, now U.S. Pat. No. 7,802,495, issued Sep. 28, 2010, and U.S. patent application Ser. No. 11/272,439, filed Nov. 10, 2005, now U.S. Pat. No. 7,776,256, issued Aug. 17, 2010, the disclosure of each of which is hereby incorporated herein by this reference in its entirety.

TECHNICAL FIELD

The present invention generally relates to earth-boring tools, and to methods of manufacturing such earth-boring tools. More particularly, the present invention generally relates to earth-boring tools that include a body having at least a portion thereof substantially formed of a particle-matrix composite material, and to methods of manufacturing such earth-boring tools.

BACKGROUND

Rotary drill bits are commonly used for drilling bore holes, or well bores, in earth formations. Rotary drill bits include two primary configurations. One configuration is the roller cone bit, which conventionally includes three roller cones mounted on support legs that extend from a bit body. Each roller cone is configured to spin or rotate on a support leg. Teeth are provided on the outer surfaces of each roller cone for cutting rock and other earth formations. The teeth often are coated with an abrasive, hard (hardfacing) material. Such materials often include tungsten carbide particles dispersed throughout a metal alloy matrix material. Alternatively, receptacles are provided on the outer surfaces of each roller cone into which hard metal inserts are secured to form the cutting elements. In some instances, these inserts comprise a superabrasive material formed on and bonded to a metallic substrate. The roller cone drill bit may be placed in a bore hole such that the roller cones abut against the earth formation to be drilled. As the drill bit is rotated under applied weight on bit, the roller cones roll across the surface of the formation, and the teeth crush the underlying formation.

A second primary configuration of a rotary drill bit is the fixed-cutter bit (often referred to as a "drag" bit), which conventionally includes a plurality of cutting elements secured to a face region of a bit body. Generally, the cutting elements of a fixed-cutter type drill bit have either a disk shape or a substantially cylindrical shape. A hard, superabrasive material, such as mutually bonded particles of polycrystalline diamond, may be provided on a substantially circular end surface of each cutting element to provide a cutting surface. Such cutting elements are often referred to as "polycrystalline diamond compact" (PDC) cutters. The cutting elements may be fabricated separately from the bit body and are secured within pockets formed in the outer surface of the bit body. A bonding material such as an adhesive or a braze alloy may be used to secure the cutting elements to the bit body. The fixed-cutter drill bit may be placed in a bore hole such that the cutting elements abut against the earth formation to be drilled. As the drill bit is rotated, the cutting elements scrape across and shear away the surface of the underlying formation.

The bit body of a rotary drill bit of either primary configuration may be secured, as is conventional, to a hardened steel shank having an American Petroleum Institute (API) threaded pin for attaching the drill bit to a drill string. The drill string includes tubular pipe and equipment segments coupled end-to-end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such particle-matrix composite materials conventionally include hard tungsten carbide particles randomly dispersed throughout a copper or copper-based alloy matrix material (often referred to as a "binder" material). Such bit bodies conventionally are formed by embedding a steel blank in tungsten carbide particulate material within a mold, and infiltrating the particulate tungsten carbide material with molten copper or copper-based alloy material. Drill bits that have bit bodies formed from such particle-matrix composite materials may exhibit increased erosion and wear resistance, but lower strength and toughness, relative to drill bits having steel bit bodies.

As subterranean drilling conditions and requirements become ever more rigorous, there arises a need in the art for novel particle-matrix composite materials for use in bit bodies of rotary drill bits that exhibit enhanced physical properties and that may be used to improve the performance of earth-boring rotary drill bits.

BRIEF SUMMARY OF THE INVENTION

In some embodiments, the present invention includes earth-boring tools for drilling subterranean formations. The tools include a bit body comprising a composite material. The composite material includes a first discontinuous phase within a continuous matrix phase. The first discontinuous phase includes silicon carbide. In some embodiments, the discontinuous phase may comprise silicon carbide particles, and the continuous matrix phase may comprise aluminum or an aluminum-based alloy. Furthermore, the first discontinuous phase may optionally comprise what may be referred to as an ABC-SiC material, as discussed in further detail below. Optionally, such ABC-SiC materials may comprise toughened ABC-SiC materials that exhibit increased fracture toughness relative to conventional silicon carbide materials.

In further embodiments, the present invention includes methods of forming earth-boring tools. The methods include providing a plurality of silicon carbide particles in a matrix material to form a body, and shaping the body to form at least a portion of an earth-boring tool for drilling subterranean formations. In some embodiments, the silicon carbide particles may comprise an ABC-SiC material. Optionally, such ABC-SiC materials may be toughened to cause the ABC-SiC materials to exhibit increased fracture toughness relative to conventional silicon carbide materials. In some embodiments, silicon carbide particles may be infiltrated with a molten matrix material, such as, for example, an aluminum or aluminum-based alloy. In additional embodiments, a green powder component may be provided that includes a plurality of particles comprising silicon carbide and a plurality of particles comprising matrix material, and the green powder component may be at least partially sintered.

In still further embodiments, the present invention includes methods of forming at least a portion of an earth-boring tool. An ABC-SiC material may be consolidated to form one or more compacts, and the compacts may be broken apart to form a plurality of ABC-SiC particles. At least a portion of a body of an earth-boring tool may be formed to comprise a composite material that includes the plurality of ABC-SiC particles. Optionally, such ABC-SiC materials may be toughened to cause the ABC-SiC materials to exhibit increased fracture toughness relative to conventional silicon carbide materials.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

The illustrations presented herein are not meant to be actual views of any particular material, apparatus, or method, but are merely idealized representations which are employed to describe embodiments of the present invention. Additionally, elements common between figures may retain the same numerical designation.

Figure 1:
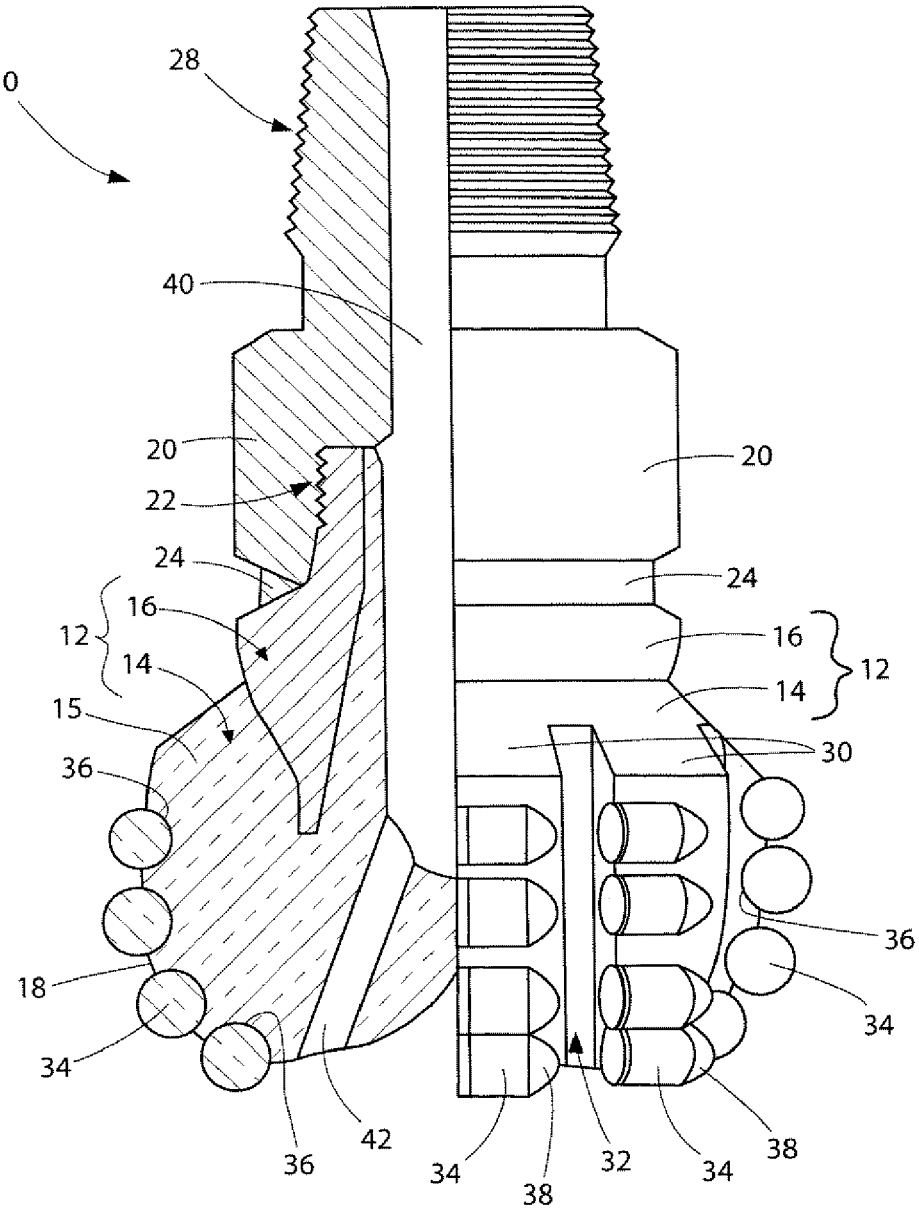
FIG. 1 is a partial cross-sectional side view of an earth-boring rotary drill bit that embodies teachings of the present invention and includes a bit body comprising a particle-matrix composite material.

An embodiment of an earth-boring rotary drill bit 10 of the present invention is shown in FIG. 1. The drill bit 10 includes a bit body 12 comprising a particle-matrix composite material 15 that includes a plurality of silicon carbide particles dispersed throughout an aluminum or an aluminum-based alloy matrix material. By way of example and not limitation, the bit body 12 may include a crown region 14 and a metal blank 16. The crown region 14 may be predominantly comprised of the particle-matrix composite material 15, as shown in FIG. 1. The metal blank 16 may comprise a metal or metal alloy, and may be configured for securing the crown region 14 of the bit body 12 to a metal shank 20 that is configured for securing the drill bit 10 to a drill string (not shown). The metal blank 16 may be secured to the crown region 14 during fabrication of the crown region 14, as discussed in further detail below. In additional embodiments, however, the drill bit 10 may not include a metal blank 16.

Figure 2:
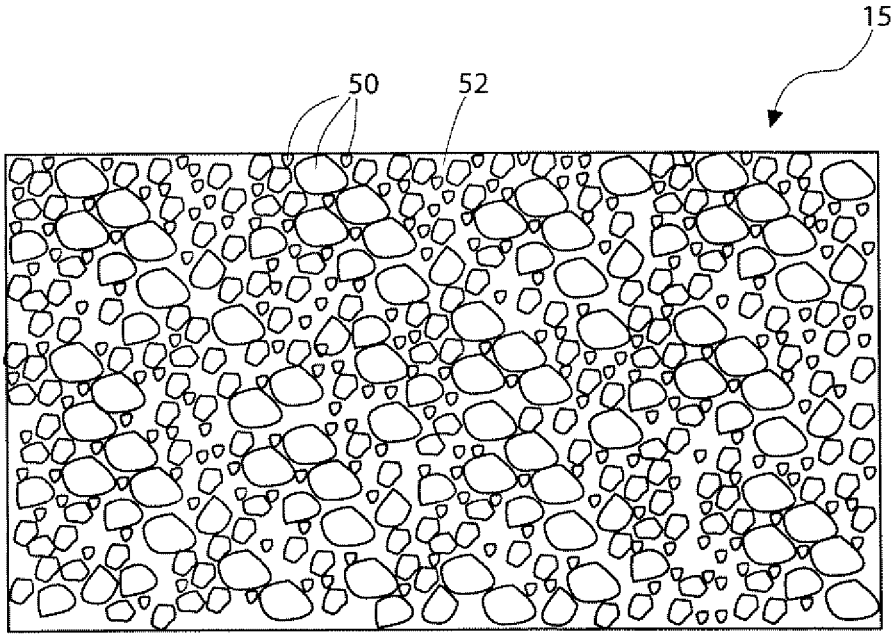
FIG. 2 is an illustration representing one example of how a microstructure of the particle-matrix composite material of the bit body of the drill bit shown in FIG. 1 may appear in a micrograph at a first level of magnification.

FIG. 2 is an illustration providing one example of how the microstructure of the particle-matrix composite material 15 may appear in a magnified micrograph acquired using, for example, an optical microscope, a scanning electron microscope (SEM), or other instrument capable of acquiring or generating a magnified image of the particle-matrix composite material 15. As shown in FIG. 2, the particle-matrix composite material 15 may include a plurality of silicon carbide (SiC) particles 50 dispersed throughout an aluminum or an aluminum-based alloy matrix material 52. In other words, the particle-matrix composite material 15 may include a plurality of discontinuous silicon carbide (SiC) phase regions dispersed throughout a continuous aluminum or an aluminum-based alloy phase. By way of example and not limitation, in some embodiments, the silicon carbide particles 50 may comprise between about forty percent (40%) and about seventy percent (70%) by weight of the particle-matrix composite material 15, and the matrix material 52 may comprise between about thirty percent (30%) and about sixty percent (60%) by weight of the particle-matrix composite material 15. In additional embodiments, the silicon carbide particles 50 may comprise between about seventy percent (70%) and about ninety-five percent (95%) by weight of the particle-matrix composite material 15, and the matrix material 52 may comprise between about thirty percent (30%) and about five percent (5%) by weight of the particle-matrix composite material 15.

As shown in FIG. 2, in some embodiments, the silicon carbide particles 50 may have different sizes. For example, the plurality of silicon carbide particles 50 may include a multi-modal particle size distribution (e.g., bi-modal, tri-modal, tetra-modal, penta-modal, etc.). In other embodiments, however, the silicon carbide particles 50 may have a substantially uniform particle size, which may exhibit a Gaussian or log-normal distribution. By way of example and not limitation, the plurality of silicon carbide particles 50 may include a plurality of −70 ASTM (American Society for Testing and Materials) mesh silicon carbide particles. As used herein, the phrase "−70 ASTM mesh particles" means particles that pass through an ASTM No. 70 U.S.A. standard testing sieve as defined in ASTM Specification E11-04, which is entitled Standard Specification for Wire Cloth and Sieves for Testing Purposes.

The silicon carbide particles 50 may comprise, for example, generally rough, non-rounded (e.g., polyhedron-shaped) particles or generally smooth, rounded particles. In some embodiments, each silicon carbide particle 50 may comprise a plurality of individual silicon carbide grains, which may be bonded to one another. Such interbonded silicon carbide grains in the silicon carbide particles 50 may be generally plate-like, or they may be generally elongated. For example, the interbonded silicon carbide grains may have an aspect ratio (the ratio of the average particle length to the average particle width) of greater than about five (5) (e.g., between about five (5) and about nine (9)).

Figure 3:
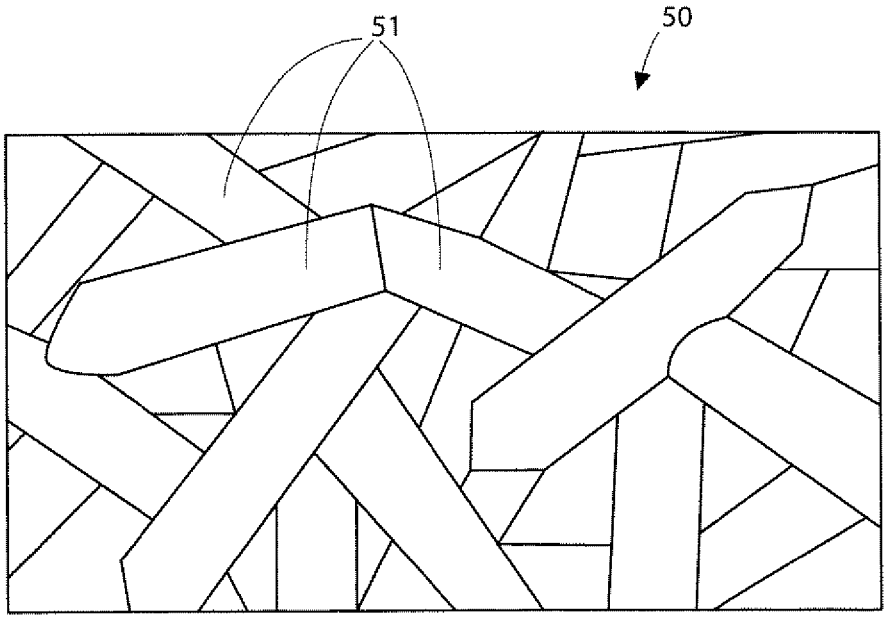
FIG. 3 is an illustration representing one example of how the microstructure of the particles of the particle-matrix composite material shown in FIG. 2 may appear at a relatively higher level of magnification.

FIG. 3 illustrates one example of how the microstructure of the silicon carbide particles 50 shown in FIG. 2 may appear at a relatively higher level of magnification. As shown in FIG. 3, each silicon carbide particle 50 may, in some embodiments, comprise a plurality of interlocked elongated and/or plate-shaped gains 51 comprising silicon carbide (and, optionally, an ABC-SiC material, which may comprise an in situ toughened ABC-SiC material).

In some embodiments, the silicon carbide particles 50 may comprise small amounts of aluminum (Al), boron (B), and carbon (C). For example, the silicon carbide material in the silicon carbide particles 50 may comprise between about one percent by weight (1.0 wt %) and about five percent by weight (5.0 wt %) aluminum, less than about one percent by weight (1.0 wt %) boron, and between about one percent by weight (1.0 wt %) and about four percent by weight (4.0 wt %) carbon. Such silicon carbide materials are referred to in the art as "ABC-SiC" materials, and may exhibit physical properties that are relatively more desirable than conventional SiC materials for purposes of forming the particle-matrix composite material 15 of the bit body 12 of the earth-boring rotary drill bit 10. As one non-limiting example, the silicon carbide material in the silicon carbide particles 50 may comprise about three percent by weight (3.0 wt %) aluminum, about six tenths of one percent by weight (0.6 wt %) boron, and about two percent by weight (2.0 wt %) carbon. In some embodiments, the silicon carbide particles 50 may comprise an ABC-SiC material that exhibits a fracture toughness of about five megapascal root meters (5.0 MPa-$m^{1/2}$) or more. More particularly, the silicon carbide particles 50 may comprise an ABC-SiC material that exhibits a fracture toughness of about six megapascal root meters (6.0 MPa-$m^{1/2}$) or more. In yet further embodiments, the silicon carbide particles 50 may comprise an ABC-SiC material that exhibits a fracture toughness of about nine megapascal root meters (9.0 MPa-$m^{1/2}$) or more. Optionally, the silicon carbide particles 50 may comprise an in situ toughened ABC-SiC material, as discussed in further detail below. Such in situ toughened ABC-SiC materials may exhibit a fracture toughness greater than about five megapascal root meters (5 MPa-$m^{1/2}$), or even greater than about six megapascal root meters (6 MPa-$m^{1/2}$). In some embodiments, the in situ toughened ABC-SiC materials may exhibit a fracture toughness greater than about nine megapascal root meters (9 MPa-$m^{1/2}$).

In some embodiments, the silicon carbide particles 50 may comprise a coating comprising a material configured to enhance the wettability of the silicon carbide particles 50 to the matrix material 52 and/or to prevent any detrimental chemical reaction from occurring between the silicon carbide particles 50 and the surrounding matrix material 52. By way of example and not limitation, the silicon carbide particles 50 may comprise a coating of at least one of tin oxide ($SnO_2$), tungsten, nickel, and titanium.

In some embodiments of the present invention, the bulk matrix material 52 may include at least seventy-five percent by weight (75 wt %) aluminum, and at least trace amounts of at least one of boron, carbon, copper, iron, lithium, magnesium, manganese, nickel, scandium, silicon, tin, zirconium, and zinc. Furthermore, in some embodiments, the matrix material 52 may include at least ninety percent by weight (90 wt %) aluminum, and at least three percent by weight (3 wt %) of at least one of boron, carbon, copper, magnesium, manganese, scandium, silicon, zirconium, and zinc. Furthermore, trace amounts of at least one of silver, gold, and indium optionally may be included in the matrix material 52 to enhance the wettability of the matrix material relative to the silicon carbide particles 50. Table 1 below sets forth various examples of compositions of matrix material 52 that may be used as the particle-matrix composite material 15 of the crown region 14 of the bit body 12 shown in FIG. 1.

TABLE 1

| Example | Approximate Elemental Weight Percent | | | | | | | | | | | |
|---|---|---|---|---|---|---|---|---|---|---|---|---|
| No. | Al | Cu | Mg | Mn | Si | Zr | Fe | Cr | Ni | Sn | Ti | Zn |
| 1 | 95.0 | 5.0 | — | — | — | — | — | — | — | — | — | — |
| 2 | 96.5 | 3.5 | — | — | — | — | — | — | — | — | — | — |
| 3 | 94.5 | 4.0 | 1.5 | — | — | — | — | — | — | — | — | — |
| 4 | 93.5 | 4.4 | 0.5 | 0.8 | 0.8 | — | — | — | — | — | — | — |
| 5 | 93.4 | 4.5 | 1.5 | 0.6 | — | — | — | — | — | — | — | — |
| 6 | 93.5 | 4.4 | 1.5 | 0.6 | — | — | — | — | — | — | — | — |
| 7 | 89.1 | 2.3 | 2.3 | — | — | 0.1 | — | — | — | — | — | 6.2 |
| 8 | 50.0 | — | — | — | 50.0 | — | — | — | — | — | — | — |
| 9 | 99.0 | 0.10 | — | — | 0.15 | — | 0.7 | — | — | — | — | 0.05 |
| 10 | 92.2 | 4.5 | 0.30 | 2.5 | 0.10 | — | 0.15 | — | — | — | 0.25 | — |
| 11 | 87.3 | 3.5 | 0.1 | 0.5 | 6.0 | — | 1.0 | — | 0.35 | — | 0.25 | 1.0 |
| 12 | 83.4 | 1.0 | 0.1 | 0.35 | 12.0 | — | 2.0 | — | 0.5 | 0.15 | — | 0.5 |
| 13 | 94.0 | 0.15 | 4.25 | 0.35 | 0.35 | 0.15 | 0.5 | — | — | — | 0.25 | — |
| 14 | 93.5 | 0.2 | 1.4 | 0.4 | 0.2 | — | 0.8 | 0.3 | — | — | 0.25 | 2.95 |
| 15 | 90.2 | 1.0 | 0.1 | 0.1 | 0.7 | — | 0.7 | — | 1.0 | 6.0 | 0.2 | — |

Figure 4:
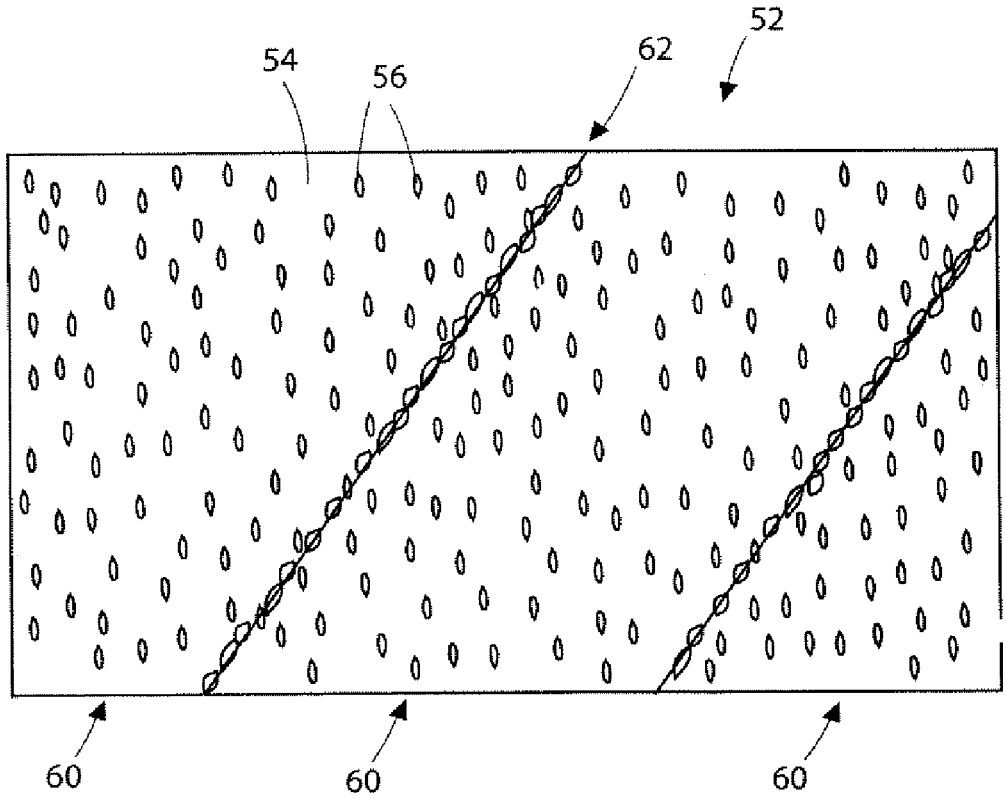
FIG. 4 is an illustration representing one example of how the microstructure of the matrix material of the particle-matrix composite material shown in FIG. 2 may appear at a relatively higher level of magnification.

FIG. 4 is an enlarged view of a region of the matrix material 52 shown in FIG. 2. FIG. 4 illustrates one example of how the microstructure of the matrix material 52 of the particle-matrix composite material 15 may appear in a micrograph at an even greater magnification level than that represented in FIG. 2. Such a micrograph may be acquired using, for example, a scanning electron microscope (SEM) or a transmission electron microscope (TEM).

By way of example and not limitation, the matrix material 52 may include a continuous phase 54 comprising a solid solution. The matrix material 52 may further include a discontinuous phase 56 comprising a plurality of discrete regions, each of which includes precipitates (i.e., a precipitate phase). In other words, the matrix material 52 may comprise a precipitation hardened aluminum-based alloy comprising between about ninety-five percent by weight (95 wt %) and about ninety-six and one-half percent by weight (96.5 wt %) aluminum and between about three and one-half percent by weight (3.5 wt %) and about five percent by weight (5 wt %) copper. In such a matrix material 52, the solid solution of the continuous phase 54 may include aluminum solvent and copper solute. In other words, the crystal structure of the solid solution may comprise mostly aluminum atoms with a relatively small number of copper atoms substituted for aluminum atoms at random locations throughout the crystal structure. Furthermore, in such a matrix material 52, the discontinuous phase 56 of the matrix material 52 may include one or more intermetallic compound precipitates (e.g., $CuAl_2$). In additional embodiments, the discontinuous phase 56 of the matrix material 52 may include additional discontinuous phases (not shown) present in the matrix material 52 that include metastable transition phases (i.e., non-equilibrium phases that are temporarily formed during formation of an equilibrium precipitate phase (e.g., $CuAl_2$)). Furthermore, in yet additional embodiments, substantially all of the discontinuous phase 56 regions may be substantially comprised of such metastable transition phases. The presence of the discontinuous phase 56 regions within the continuous phase 54 may impart one or more desirable properties to the matrix material 52, such as, for example, increased hardness. Furthermore, in some embodiments, metastable transition phases may impart one or more physical properties to the matrix material 52 that are more desirable than those imparted to the matrix material 52 by equilibrium precipitate phases (e.g., $CuAl_2$).

With continued reference to FIG. 4, the matrix material 52 may include a plurality of grains 60 that abut one another along grain boundaries 62. As shown in FIG. 4, a relatively high concentration of a discontinuous precipitate phase 56 may be present along the grain boundaries 62. In some embodiments of the present invention, the grains 60 of matrix material 52 may have at least one of a size and shape that is tailored to enhance one or more mechanical properties of the matrix material 52. For example, in some embodiments, the grains 60 of matrix material 52 may have a relatively smaller size (e.g., an average grain size of about six microns (6 μm) or less) to impart increased hardness to the matrix material 52, while in other embodiments, the grains 60 of matrix material 52 may have a relatively larger size (e.g., an average grain size of greater than six microns (6 μm)) to impart increased toughness to the matrix material 52. The size and shape of the grains 60 may be selectively tailored using heat treatments such as, for example, quenching and annealing, as known in the art. Furthermore, at least trace amounts of at least one of titanium and boron optionally may be included in the matrix material 52 to facilitate grain size refinement.

Referring again to FIG. 1, the bit body 12 may be secured to the metal shank 20 by way of, for example, a threaded connection 22 and a weld 24 that extends around the drill bit 10 on an exterior surface thereof along an interface between the bit body 12 and the metal shank 20. The metal shank 20 may be formed from steel, and may include a threaded pin 28 conforming to American Petroleum Institute (API) standards for attaching the drill bit 10 to a drill string (not shown).

As shown in FIG. 1, the bit body 12 may include wings or blades 30 that are separated from one another by junk slots 32. Internal fluid passageways 42 may extend between the face 18 of the bit body 12 and a longitudinal bore 40, which extends through the steel shank 20 and at least partially through the bit body 12. In some embodiments, nozzle inserts (not shown) may be provided at the face 18 of the bit body 12 within the internal fluid passageways 42.

The drill bit 10 may include a plurality of cutting structures on the face 18 thereof. By way of example and not limitation, a plurality of polycrystalline diamond compact (PDC) cutters 34 may be provided on each of the blades 30, as shown in FIG. 1. The PDC cutters 34 may be provided along the blades 30 within pockets 36 formed in the face 18 of the bit body 12, and may be supported from behind by buttresses 38, which may be integrally formed with the crown region 14 of the bit body 12.

The steel blank 16 shown in FIG. 1 may be generally cylindrically tubular. In additional embodiments, the steel blank 16 may have a fairly complex configuration and may include external protrusions corresponding to blades 30 or other features extending on the face 18 of the bit body 12.

The rotary drill bit 10 shown in FIG. 1 may be fabricated by separately forming the bit body 12 and the shank 20, and then attaching the shank 20 and the bit body 12 together. The bit body 12 may be formed by a variety of techniques, some of which are described in further detail below.

In some embodiments, the bit body 12 may be formed using so-called "suspension" or "dispersion" casting techniques. For example, a mold (not shown) may be provided that includes a mold cavity having a size and shape corresponding to the size and shape of the bit body 12. The mold may be formed from, for example, graphite or any other high-temperature refractory material, such as a ceramic. The mold cavity of the mold may be machined using a five-axis machine tool. Fine features may be added to the cavity of the mold using hand-held tools. Additional clay work also may be required to obtain the desired configuration of some features of the bit body 12. Where necessary, preform elements or displacements (which may comprise ceramic components, graphite components, or resin-coated sand compact components) may be positioned within the mold cavity and used to define the internal passageways 42, cutting element pockets 36, junk slots 32, and other external topographic features of the bit body 12.

After forming the mold, a suspension may be prepared that includes a plurality of silicon carbide particles 50 (FIG. 2) suspended within molten matrix material 52. Molten matrix material 52 having a composition as previously described herein then may be prepared by mixing stock material, particulate material, and/or powder material of each of the various elemental constituents in their respective weight percentages in a container and heating the mixture to a temperature sufficient to cause the mixture to melt, forming a molten matrix material 52 of desired composition. After forming the molten matrix material 52 of desired composition, silicon carbide particles 50 may be suspended and dispersed throughout the molten matrix material 52 to form the suspension. As previously mentioned, in some embodiments, the silicon carbide particles 50 may be coated with a material configured to enhance the wettability of the silicon carbide particles 50 to the molten matrix material 52 and/or to prevent any detrimental chemical reaction from occurring between the silicon carbide particles 50 and the molten matrix material 52. By way of example and not limitation, the silicon carbide particles 50 may comprise a coating of tin oxide ($SnO_2$).

Optionally, a metal blank 16 (FIG. 1) may be at least partially positioned within the mold such that the suspension may be cast around the metal blank 16 within the mold.

The suspension comprising the silicon carbide particles 50 and molten matrix material 52 may be poured into the mold cavity of the mold. As the molten matrix material 52 (e.g., molten aluminum or aluminum-based alloy materials) may be susceptible to oxidation, the infiltration process may be carried out under vacuum. In additional embodiments, the molten matrix material 52 may be substantially flooded with an inert gas or a reductant gas to prevent oxidation of the molten matrix material 52. In some embodiments, pressure may be applied to the suspension during casting to facilitate the casting process and to substantially prevent the formation of voids within the bit body 12 being formed.

After casting the suspension within the mold, the molten matrix material 52 may be allowed to cool and solidify, forming a solid matrix material 52 of the particle-matrix composite material 15 around the silicon carbide particles 50.

In some embodiments, the bit body 12 may be formed using so-called "infiltration" casting techniques. For example, a mold (not shown) may be provided that includes a mold cavity having a size and shape corresponding to the size and shape of the bit body 12. The mold may be formed from, for example, graphite or any other high-temperature refractory material, such as a ceramic. The mold cavity of the mold may be machined using a five-axis machine tool. Fine features may be added to the cavity of the mold using hand-held tools. Additional clay work also may be required to obtain the desired configuration of some features of the bit body 12. Where necessary, preform elements or displacements (which may comprise ceramic components, graphite components, or resin-coated sand compact components) may be positioned within the mold cavity and used to define the internal passageways 42, cutting element pockets 36, junk slots 32, and other external topographic features of the bit body 12.

After forming the mold, a plurality of silicon carbide particles 50 (FIG. 2) may be provided within the mold cavity to form a body having a shape that corresponds to at least the crown region 14 of the bit body 12. Optionally, a metal blank 16 (FIG. 1) may be at least partially embedded within the silicon carbide particles 50 such that at least one surface of the blank 16 is exposed to allow subsequent machining of the surface of the metal blank 16 (if necessary) and subsequent attachment to the shank 20.

Molten matrix material 52 having a composition as previously described herein, then may be prepared by mixing stock material, particulate material, and/or powder material of each of the various elemental constituents in their respective weight percentages, heating the mixture to a temperature sufficient to cause the mixture to melt, thereby forming a molten matrix material 52 of desired composition. The molten matrix material 52 then may be allowed or caused to infiltrate the spaces between the silicon carbide particles 50 within the mold cavity. Optionally, pressure may be applied to the molten matrix material 52 to facilitate the infiltration process as necessary or desired. As the molten materials (e.g., molten aluminum or aluminum-based alloy materials) may be susceptible to oxidation, the infiltration process may be carried out under vacuum. In additional embodiments, the molten materials may be substantially flooded with an inert gas or a reductant gas to prevent oxidation of the molten materials. In some embodiments, pressure may be applied to the molten matrix material 52 and silicon carbide particles 50 to facilitate the infiltration process and to substantially prevent the formation of voids within the bit body 12 being formed.

After the silicon carbide particles 50 have been infiltrated with the molten matrix material 52, the molten matrix material 52 may be allowed to cool and solidify, forming the solid matrix material 52 of the particle-matrix composite material 15.

In additional embodiments, reactive infiltration casting techniques may be used to form the bit body 12. By way of example and not limitation, the mass to be infiltrated may comprise carbon, and molten silicon may be added to the molten matrix material 52. The molten silicon may react with the carbon to form silicon carbide as the molten mixture infiltrates the carbon material. In this manner, a reaction may be used to form silicon carbide particles 50 in situ during the infiltration casting process.

In some embodiments, the bit body 12 may be formed using so-called particle compaction and sintering techniques such as, for example, those disclosed in application Ser. No. 11/271,153, filed Nov. 10, 2005, now U.S. Pat. No. 7,802,495, issued Sep. 28, 2010, and application Ser. No. 11/272,439, filed Nov. 10, 2005, now U.S. Pat. No. 7,776,256, issued Aug. 17, 2010. Briefly, a powder mixture may be pressed to form a green bit body or billet, which then may be sintered one or more times to form a bit body 12 having a desired final density.

The powder mixture may include a plurality of silicon carbide particles 50 and a plurality of particles comprising a matrix material 52, as previously described herein. Optionally, the powder mixture may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction. Furthermore, the powder mixture may be milled, which may result in the silicon carbide particles 50 being at least partially coated with matrix material 52.

The powder mixture may be pressed (e.g., axially within a mold or die, or substantially isostatically within a mold or container) to form a green bit body. The green bit body may be machined or otherwise shaped to form features such as blades, fluid courses, internal longitudinal bores, cutting element pockets, etc., prior to sintering. In some embodiments, the green bit body (with or without machining) may be partially sintered to form a brown bit body, and the brown bit body may be machined or otherwise shaped to form one or more such features prior to sintering the brown bit body to a desired final density.

The sintering processes may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes may include subliquidus phase sintering. In other words, the sintering processes may be conducted at temperatures proximate to but below the liquidus line of the phase diagram for the matrix material. For example, the sintering processes described herein may be conducted using a number of different methods known to one of ordinary skill in the art, such as the Rapid Omnidirectional Compaction (ROC) process, the CERACON® process, hot isostatic pressing (HIP), or adaptations of such processes.

When the bit body 12 is formed by particle compaction and sintering techniques, the bit body 12 may not include a metal blank 16 and may be secured to the shank 20 by, for example, one or more of brazing, welding, and mechanically interlocking.

As previously mentioned, in some embodiments, the silicon carbide particles 50 may comprise an in situ toughened ABC-SiC material. In such embodiments, the bit body 12 may be formed by various methods, including those described below.

In some embodiments of methods of forming a bit body 12 of the present invention, particles of ABC-SiC may be consolidated to form relatively larger structures or compacts by, for example, hot pressing particles of ABC-SiC at elevated temperatures (e.g., between about 1,650° C. and about 1,950° C.) and pressures (e.g., about fifty megapascals (50 MPa)) for a period of time (e.g., about one hour) in an inert gas (e.g., argon).

After consolidation of the ABC-SiC particles to form relatively larger compacts, the compacts may be annealed to tailor the size and shape of the SiC grains in a manner that enhances the fracture toughness of the ABC-SiC material (e.g., to toughen the ABC-SiC material in situ). By way of example, the relatively larger compacts may be annealed at elevated temperatures (e.g., about 1,000° C. or more) for a time period of about one hour or more) in an inert gas.

The consolidated and annealed compacts then may be crushed or otherwise broken up (e.g., in a ball mill or an attritor mill) to form relatively smaller silicon carbide particles 50 comprising the in situ toughened ABC-SiC material. Optionally the relatively smaller silicon carbide particles 50 comprising the in situ toughened ABC-SiC material may be screened to separate the particles into certain particle size ranges, and only selected particle size ranges may be used in forming the bit body 12. The silicon carbide particles 50 comprising the in situ toughened ABC-SiC material then may be used to form the bit body 12 by, for example, using any of the suspension casting, infiltration casting, or particle compaction and sintering methods previously described herein.

In additional embodiments of methods of forming a bit body 12 of the present invention, particles of ABC-SiC may be consolidated to form relatively larger compacts as previously described. Prior to annealing (and in situ toughening of the ABC-SiC), however, the relatively larger compacts may be crushed or broken up to form relatively smaller silicon carbide particles 50 comprising the ABC-SiC material. The silicon carbide particles 50 comprising the ABC-SiC material then may be used to form the bit body 12 by, for example, using any of the suspension casting, infiltration casting, or particle compaction and sintering methods previously described herein. A matrix material 52 may be used that has a sufficiently high melting point (e.g., greater than about 1,250° C.) to allow annealing and in situ toughening of the ABC-SiC material after forming the bit body 12 without causing incipient melting of the matrix material 52 or undue dissolution between the matrix material 52 and the silicon carbide particles 50. Such matrix materials 52 may include, for example, cobalt, cobalt-based alloys, nickel, nickel-based alloys, or a combination of such materials. In this manner, the ABC-SiC material may be in situ toughened after forming the bit body 12.

In further embodiments of methods of forming a bit body 12 of the present invention, particles of ABC-SiC may be consolidated to form a first set of relatively larger compacts as previously described. Prior to annealing (and in situ toughening of the ABC-SiC), however, the relatively larger compacts may be crushed or broken up to form relatively smaller silicon carbide particles comprising the ABC-SiC material. A second set of relatively larger compacts may be formed by infiltrating (or otherwise consolidating) the silicon carbide particles 50 comprising the ABC-SiC material with a first material that has a sufficiently high melting point (e.g., greater than about 1,250° C.) to allow annealing and in situ toughening of the ABC-SiC material after infiltrating with the first material. The second set of compacts then may be annealed and in situ toughened, as previously described, after which the second set of compacts may be crushed or otherwise broken up to form the relatively smaller silicon carbide particles 50 comprising in situ toughened ABC-SiC material. The silicon carbide particles 50 comprising the in situ toughened ABC-SiC material then may be used to form the bit body 12 by, for example, using any of the suspension casting, infiltration casting, or particle compaction and sintering methods previously described herein. A matrix material 52 may be used having a melting point such that the bit body 12 may be formed without causing incipient melting of the first material (which is used to infiltrate the ABC-SiC particles prior to in situ toughening), or undue dissolution between the matrix material 52 and the first material or the silicon carbide particles 50.

After or during formation of the bit body 12, the bit body 12 optionally may be subjected to one or more thermal treatments (different than in situ toughening, as previously described) to selectively tailor one or more physical properties of at least one of the matrix material 52 and the silicon carbide particles 50.

For example, the matrix material 52 may be subjected to a precipitation hardening process to form a discontinuous phase 56 comprising precipitates, as previously described in relation to FIG. 4. For example, the matrix material 52 may comprise between about 95% and about 96.5% by weight aluminum and between about 3.5% and about 5% by weight copper, as previously described. In fabricating the bit body 12 in an infiltration casting type process, as described above, the matrix material 52 may be heated to a temperature of greater than about 548° C. (a eutectic temperature for the particular alloy) for a sufficient time to allow the composition of the molten matrix material 52 to become substantially homogenous. The substantially homogenous molten matrix material 52 may be poured into a mold cavity and allowed to infiltrate the spaces between silicon carbide particles 50 within the mold cavity. After substantially complete infiltration of the silicon carbide particles 50, the temperature of the molten matrix material 52 may be cooled relatively rapidly (i.e., quenched) to a temperature of less than about 100° C. to cause the matrix material 52 to solidify without formation of a significant amount of discontinuous precipitate phases. The temperature of the matrix material 52 then may be heated to a temperature of between about 100° C. and about 548° C. for a sufficient amount of time to allow the formation of a selected amount of discontinuous precipitate phase (e.g., metastable transition precipitation phases, and/or equilibrium precipitation phases). In additional embodiments, the composition of the matrix material 52 may be selected to allow a pre-selected amount of precipitation hardening within the matrix material 52 over time and under ambient temperatures and/or temperatures attained while drilling with the drill bit 10, thereby eliminating the need for a heat treatment at elevated temperatures.

Tungsten carbide materials have been used for many years to form bodies of earth-boring tools. Silicon carbide generally exhibits higher hardness than tungsten carbide materials. Silicon carbide materials also may exhibit superior wear resistance and erosion resistance relative to tungsten carbide materials. Therefore, embodiments of the present invention may provide earth-boring tools that exhibit relatively higher hardness, improved wear resistance, and/or improved erosion resistance relative to conventional tools comprising tungsten carbide composite materials. Furthermore, by employing toughened silicon carbide materials, as disclosed herein, earth-boring tools may be provided that comprise silicon carbide composite materials that exhibit increased fracture toughness.

While the present invention is described herein in relation to embodiments of concentric earth-boring rotary drill bits that include fixed cutters and to embodiments of methods for forming such drill bits, the present invention also encompasses other types of earth-boring tools such as, for example, core bits, eccentric bits, bicenter bits, reamers, mills, and roller cone bits, as well as methods for forming such tools. Thus, as employed herein, the term "bit body" includes and encompasses bodies of all of the foregoing structures, as well as components and subcomponents of such structures.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutter types.

What is claimed is:

1. An earth-boring tool for drilling subterranean formations, the tool comprising:

a bit body including a crown region comprising a particle-matrix composite material, the particle-matrix composite material comprising a plurality of silicon carbide particles dispersed throughout an aluminum or an aluminum-based alloy matrix material, the silicon carbide particles of the plurality of silicon carbide particles comprising between about one percent by weight (1 wt %) and about five percent by weight (5 wt %) aluminum, between zero percent by weight (0 wt %) and about one percent by weight (1 wt %) boron, and between about one percent by weight (1 wt %) and about four percent by weight (4 wt %) carbon; and at least one cutting structure disposed on a face of the bit body.

2. The earth-boring tool of claim 1, wherein the plurality of silicon carbide particles comprises between about 40% and about 70% by weight of the particle-matrix composite material, and wherein the aluminum or aluminum-based alloy matrix material comprises between about 30% and about 60% by weight of the particle-matrix composite material.

3. The earth-boring tool of claim 1, wherein the aluminum or aluminum-based alloy matrix material of the particle-matrix composite material comprises at least 75% by weight aluminum and at least trace amounts of at least one of boron, carbon, copper, iron, lithium, magnesium, manganese, nickel, scandium, silicon, tin, zirconium, and zinc.

4. The earth-boring tool of claim 1, wherein the aluminum or aluminum-based alloy matrix material of the particle-matrix composite material comprises at least one discontinuous precipitate phase dispersed through a continuous phase comprising a solid solution.

5. An earth-boring tool for drilling subterranean formations, the tool comprising:

a bit body comprising a composite material, the composite material comprising a first discontinuous phase dispersed throughout a continuous matrix phase, the first discontinuous phase comprising a silicon carbide material including between about one percent by weight (1 wt %) and about five percent by weight (5 wt %) aluminum, between zero percent by weight (0 wt %) and about one percent by weight (1 wt %) boron, and between about one percent by weight (1 wt %) and about four percent by weight (4 wt %) carbon.

6. The earth-boring tool of claim 5, wherein the silicon carbide material comprises a toughened silicon carbide material and exhibits a fracture toughness greater than about 5 MPa-$m^{1/2}$.

7. The earth-boring tool of claim 5, wherein the matrix phase comprises at least 75% by weight aluminum and at least trace amounts of at least one of boron, carbon, copper, iron, lithium, magnesium, manganese, nickel, scandium, silicon, tin, zirconium, and zinc.

8. A method of forming an earth-boring tool, the method comprising:

providing a plurality of silicon carbide particles within a cavity of a mold, the cavity having a shape corresponding to at least a portion of a bit body of an earth-boring tool for drilling subterranean formations, providing the plurality of silicon carbide particles comprising:

selecting the silicon carbide material to comprise between about one percent by weight (1 wt %) and about five percent by weight (5 wt %) aluminum, between zero percent by weight (0 wt %) and about one percent by weight (1 wt %) boron, and between about one percent by weight (1 wt %) and about four percent by weight (4 wt %) carbon;

infiltrating the plurality of silicon carbide particles with a molten aluminum or aluminum-based material; and cooling the molten aluminum or aluminum-based material to form a solid matrix material surrounding the plurality of silicon carbide particles.

9. The method of claim 8, further comprising heat treating the solid matrix material to increase the hardness of the solid matrix material.

10. The method of claim 8, wherein infiltrating the plurality of silicon carbide particles comprises infiltrating the plurality of silicon carbide particles with a molten material comprising at least 75% by weight aluminum and at least trace amounts of at least one of copper, iron, lithium, magnesium, manganese, nickel, scandium, silicon, tin, zirconium, and zinc.

11. The method of claim 8, further comprising:

cooling the molten material to form a solid solution; and forming at least one discontinuous precipitate phase within the solid solution, the at least one discontinuous precipitate phase causing the solid matrix material to exhibit a bulk hardness that is harder than a bulk hardness of the solid solution.

* * * * *